US006435634B1

(12) United States Patent
Webb et al.

(10) Patent No.: US 6,435,634 B1
(45) Date of Patent: Aug. 20, 2002

(54) DOCUMENT DISPLAY SHELF APPARATUS

(75) Inventors: Audrey K. Webb; John R. Hamilton, both of Grand Rapids; Michael W. Welsh, Rockford; Scott M. Miller, Kentwood; Kevin B. Miller, Wayland, all of MI (US)

(73) Assignee: Steelcase Development Corporation, Caledonia, MI (US)

( * ) Notice: Subject to any disclaimer, the term of this patent is extended or adjusted under 35 U.S.C. 154(b) by 13 days.

(21) Appl. No.: 09/781,696

(22) Filed: Feb. 12, 2001

(51) Int. Cl.[7] ..... A47F 5/08

(52) U.S. Cl. ..... 312/313; 312/323; 312/248; 248/447

(58) Field of Search ..... 312/246, 247, 312/248, 313, 280, 233, 325, 323; 248/447, 454, 462; 108/42, 39, 40, 9, 10, 95, 96, 147.11, 149

(56) References Cited

U.S. PATENT DOCUMENTS

| | | | | |
|---|---|---|---|---|
| 1,147,998 A | * | 7/1915 | Anderson | |
| 2,254,832 A | | 9/1941 | Weight | |
| 2,450,233 A | * | 9/1948 | Cummings | |
| 2,599,416 A | | 6/1952 | Saecker | |
| 2,839,349 A | | 6/1958 | Culver | |
| 3,623,168 A | * | 11/1971 | Rouch | |
| 3,846,005 A | * | 11/1974 | Harper et al. | 312/248 |
| D264,159 S | * | 5/1982 | Bennett et al. | |
| 4,343,244 A | | 8/1982 | Moriarty et al. | |
| 4,441,771 A | | 4/1984 | Roesler | |
| 4,460,145 A | | 7/1984 | Ando | |
| 4,528,825 A | * | 7/1985 | Khan | 312/313 X |
| 5,215,364 A | | 6/1993 | Moore | |
| 5,244,272 A | | 9/1993 | Thompson | |
| 5,302,015 A | | 4/1994 | DuVall | |
| 5,348,385 A | | 9/1994 | Berg | |
| 5,646,819 A | * | 7/1997 | Hill, III | |
| 5,845,979 A | | 12/1998 | Longhurst et al. | |
| 5,957,558 A | | 9/1999 | Quade | |

FOREIGN PATENT DOCUMENTS

| | | | | |
|---|---|---|---|---|
| FR | 2652248 | * | 3/1991 | 312/330.1 |

* cited by examiner

*Primary Examiner*—Janet M. Wilkens
(74) *Attorney, Agent, or Firm*—Price Heneveld Cooper DeWitt & Litton

(57) ABSTRACT

An office furniture system includes a furniture unit, such as a binder bin or main shelf, mounted to a partition. A display shelf assembly is mounted to the furniture unit, and includes a movable shelf, a first bent-wire support fixedly attached to the furniture unit and slidingly attached to the shelf, and a second bent-wire support operably pivotally attached to the furniture unit and pivotally attached to the shelf. The first and second support members are configured to support the shelf through a range of motion between a substantially horizontal storage position and a vertically inclined display position. In one embodiment, the second support is operably attached to the furniture unit for both pivoting and sliding movement.

26 Claims, 6 Drawing Sheets

DOCUMENT DISPLAY SHELF APPARATUS

BACKGROUND

The present invention relates to a shelf movably supported on a partition and adapted to move between a retracted storage position and an extended angled use position, such as may be used in office furniture to support working papers and readable materials, but which is not limited to only these items.

Functional storage is needed in modern office environments in order to efficiently deal with high volumes of paper and printed information in small office areas where space is at a premium. One way to increase usable space on a work surface is to support printed materials above the worksurface at a height that facilitates reading and viewing, and that at the same time allows work to be done on the work surface. For example, Ando patent U.S. Pat. No. 4,460,145 discloses a prior art book rest supported by levers in a four bar linkage arrangement for movement between an angled use position (FIG. 1) and a storage position (FIG. 2). However, improvements are desired. For example, it is desirable to provide an arrangement that does not require a separate latch (see magnet 8 in Ando '145) to hold the shelf in a storage position, since the latch could release and cause materials stored on the shelf to be dumped. Further, an arrangement is desired that is stable without depending on any latch. Still further, a shelf arrangement is desired that is low cost, durable, functional, stable, and provides good positioning and spacing in all operative positions. Still further, a shelf arrangement is desired that includes relatively few parts, is readily operable and is inherently clear how to operate, yet that provides a clean aesthetic appearance. Also, a shelf arrangement is desired that is retrofittable and field-installable, and that is a modular, self-contained unit so that it is attachable to variety of furniture units without additional parts and pieces.

Accordingly, an apparatus solving the aforementioned problems and having the aforementioned advantages is desired.

SUMMARY OF THE INVENTION

In one aspect of the present invention, a document display shelf assembly is provided for use under a furniture unit mounted at a vertical height above a floor. The document display shelf assembly includes a movable shelf panel having a range of motion, a first support member adapted to be fixedly attached to the furniture unit at a first location, and a second support member with first and second sections adapted for pivotal attachment to the furniture unit and the shelf panel, respectively. The shelf panel is slidingly attached to the first support member and also pivotally attached to the second support member at the second section. By this arrangement, the shelf panel is slidingly supported by the first support member at a predetermined vertical distance below the first location throughout the range of motion and the shelf panel is pivotally supported by the second support member for vertical displacement. As a result, the shelf panel can be moved from a substantially horizontal storage position to a display position where the shelf panel is positioned at a vertical inclination.

In another aspect of the present invention, a document display shelf assembly is provided for use under a furniture unit mounted at a vertical distance above a floor, where the document display assembly includes a shelf movable between a substantially horizontal storage position and a predetermined vertically inclined display position. A first support member is adapted to be fixedly attached to the furniture unit, with the shelf being slidingly attached to the first support member. A second support member has a first section for pivotal attachment to the furniture unit and a second section pivotally engaging the shelf. At least one stop member is disposed on the second support member and pivotally movable therewith, so that movement of the shelf to the display position causes pivotal movement of the second support member to an abutting position relative to the furniture unit. By this arrangement, the stop member engages a surface of the furniture unit when the shelf is in the display position.

In yet another aspect of the present invention, an office furniture system includes a partition panel assembly, and a worksurface panel mounted to the partition panel assembly in a substantially horizontal orientation. A furniture unit is mounted to the partition panel assembly at a vertical distance above the worksurface panel. A display shelf assembly is mounted to the furniture system at a height between the worksurface panel and the furniture unit. The display shelf assembly includes a movable shelf, a first support member fixedly positioned relative to the furniture unit and slidingly attached to the shelf, and a second support member pivotally mounted relative to the furniture unit and pivotally attached to the shelf. The first and second support members are configured to support the shelf through a range of motion between a substantially horizontal storage position and a vertically inclined display position. The shelf is slidingly engaged by the first support member at a point positioned at a predetermined vertical height throughout the range of motion.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
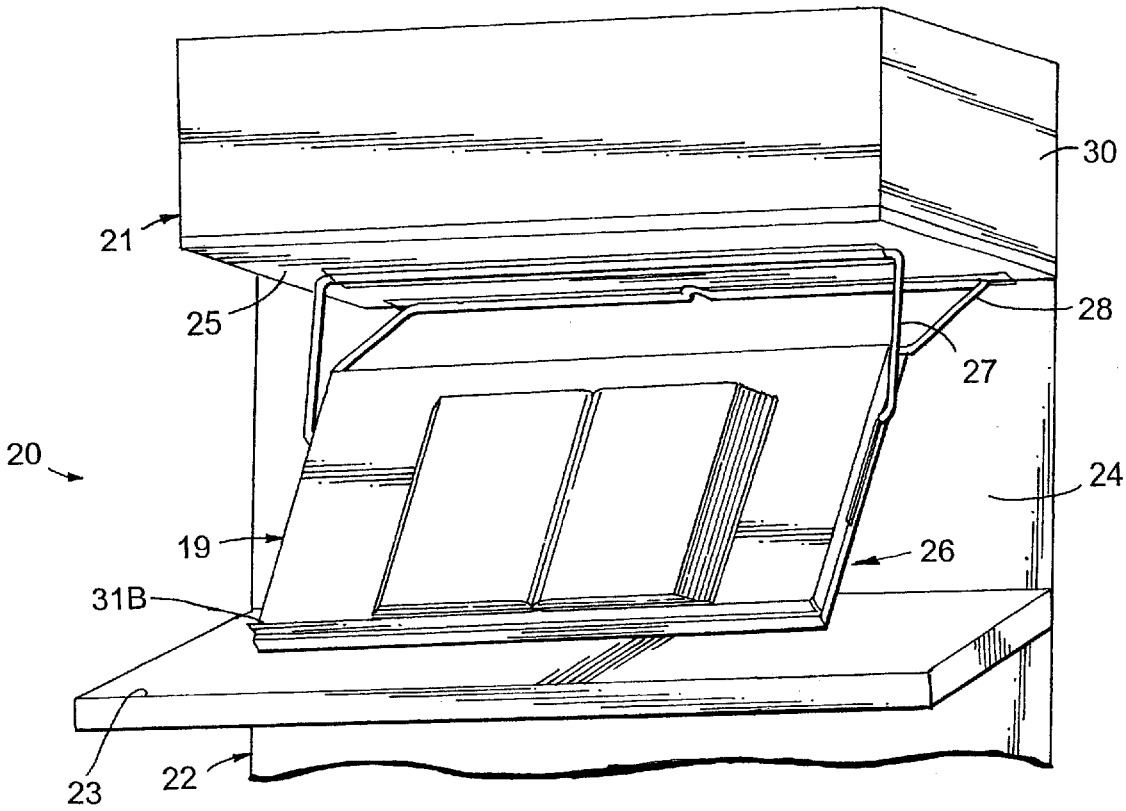
FIG. 1 is a perspective view of a shelving apparatus mounted to a partition panel, the shelving apparatus including a shelf positioned at an angled, inclined use position.
Figure 2:
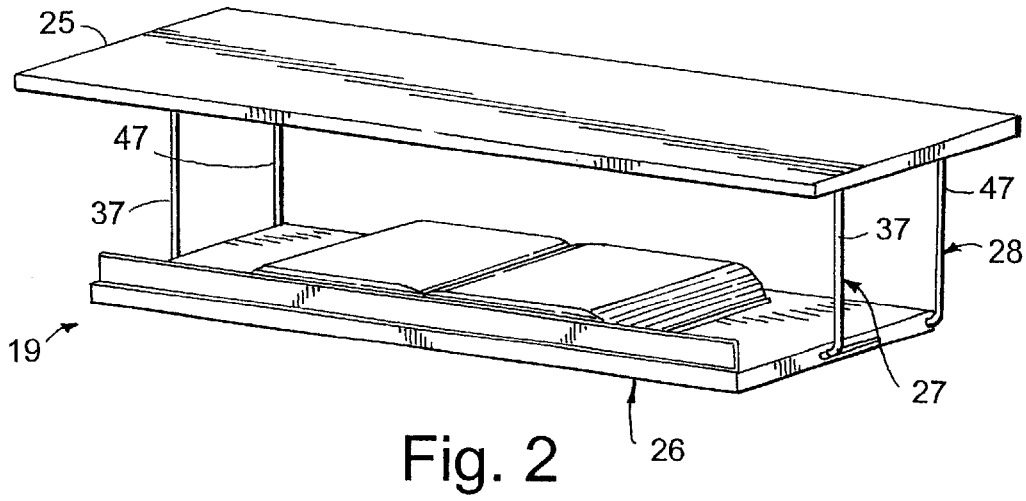
FIG. 2 is a perspective view of the shelving apparatus of FIG. 1, the shelf being positioned in a storage position.

An office furniture system 20 (FIG. 1) includes a furniture unit 21, such as a binder bin or fixed top shelf, mounted to a partition 22. Other items can be mounted to the partition 22, such as a worksurface 23 or the like, to define an open space 24 under a bottom 25 of the furniture unit 21. A display shelf assembly/apparatus 19 is mounted to the bottom 25 of the furniture unit 21, and includes a movable shelf 26, a front bent-wire support 27 fixedly attached to the furniture unit 21 and slidingly attached to the shelf 26, and a rear bent-wire support 28 operably pivotally attached to the furniture unit 21 and pivotally attached to the shelf 26. The first and second support members 27 and 28 are configured to support the shelf 26 through a range of motion between a substantially horizontal storage position (FIG. 2) and a vertically angled display/use position (FIG. 1).

The illustrated furniture unit 21 (FIG. 1) includes a primary or fixed top shelf panel forming the bottom 25. It is contemplated that the bottom 25 can be incorporated into a binder bin 30 (shown in dashed lines) or other furniture accessory. It should be clear to a person of ordinary skill that any furniture unit having strength and defining an open space can be used to support the present inventive movable shelf 26 with supports 27 and 28. In the illustrated embodiment, the open space 24 is defined under the bottom 25 and above the worksurface 23. However, it is to be understood that the worksurface 23 is not required for use of the present inventive shelving apparatus.

It is contemplated that the present invention will work well with many different types of partitions. For example, the present invention can be used with Steelcase partitions sold under the trade names ANSWER, SEGMENT, and MONTAGE, as well as other partition systems.

Figure 3:
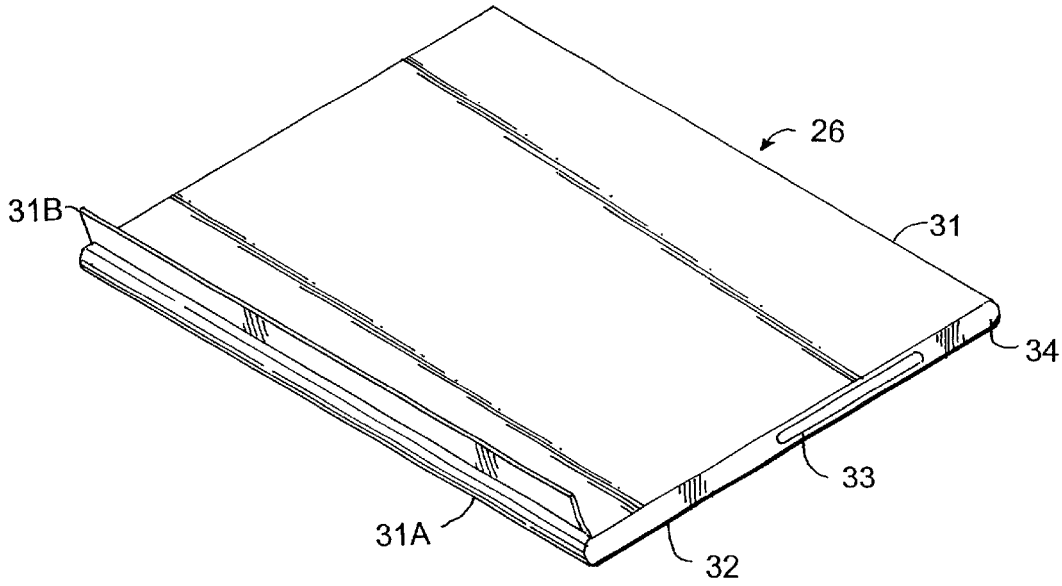
FIG. 3 is a perspective view of the shelf of FIG. 1.

The shelf 26 (FIG. 3) includes a panel body 31, and a front edge cover 31A that includes a perpendicularly protruding flange 3lB. Where the body 31 is made of a wood product or otherwise requires added strength, edge guards 32 are attached along opposite side edges of the body 31. The edge guard 32 includes a recess 33 defining an edge slot having a predetermined length, and further includes a hole 34 defining an edge pivot at a rear corner of the body 31. Where the panel body 31 is made of metal or other strong material, or where the panel body 31 is light weight, the recess 33 and hole 34 may potentially be integrally formed in the body 31 without a separate reinforcing edge guard 32. Bearings can be inserted into the recess 33 and/or into the hole 34 where improved lubricity is desired.

Figure 7:
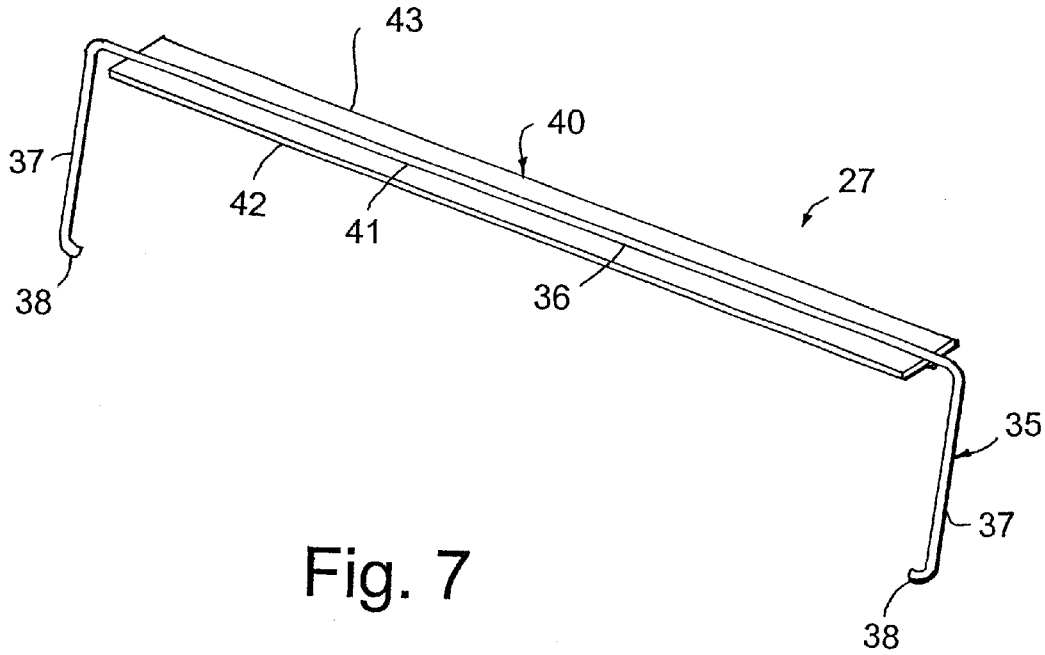
FIG. 7 is a perspective view showing the front support and attachment bracket of FIG. 1.

The front support 27 (FIG. 7) includes a first part 35 made from a metal wire or rod bent into the illustrated "U" shape, and a bracket 40 fixedly attached to the first part 35. More specifically, the first part 35 includes a center section 36, perpendicular side sections 37, and inwardly bent pivot sections 38. The mounting bracket 40 includes a U-shaped center trough 41 shaped to mateably engage the center section 36, and further includes side flanges 42 and 43 with holes for screw attachment to a bottom surface of the bottom 25. The mounting bracket 40 is spot welded or otherwise secured to the first support 27 to prevent undesired rotation of the first part 35. A bearing can be snapped onto the inwardly bent pivot sections 38 instead of into the holes 34 if desired.

Figure 4:
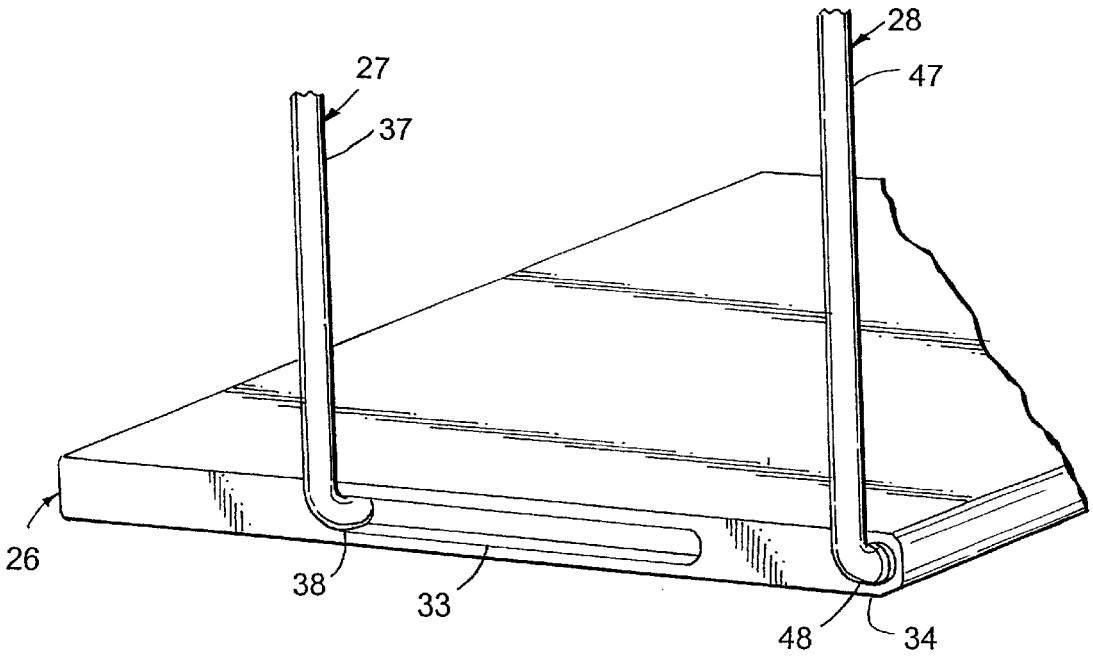
FIG. 4 is an enlarged fragmentary view of a rear side comer of the shelf shown in FIG. 2.

The rear support 28 (FIGS. 4 and 6) includes a first part 45 also made from a metal wire or rod that is bent into a "U" shape, and further includes a second one of the mounting brackets 40. The rod part 45 includes a center section 46, perpendicular side sections 47, and inwardly bent pivot sections 48. In rear support 28, the rod part 45 is not attached to the bracket 40, but instead rotatably engages the same. The center section 46 further includes a small looped section 49 formed in a center of the center section 46. The looped section 49 is angled relative to the side sections 47 and forms a stop that engages a bottom surface of the bottom 25 as the shelf 26 is moved to the angled use position. (See FIG. 5.) The mounting bracket 40 includes an aperture 50 shaped to receive the looped section 49. The aperture 50 is shaped to permit limited rotation of the looped section 49 as the shelf 26 is moved and the rear support 28 rotated. As illustrated, the aperture 50 is shaped so that the looped section 49 engages the side flange 42 when the shelf 26 is moved to its use position. For example, this is beneficial to prevent the looped section 49 from tearing into or wearing into the bottom 25 over time.

In operation, the shelf 26 is initially positioned in a storage position (FIGS. 2 and 5), where the panel body 31 is oriented generally horizontally. In this position, the front support 27 is slid to a front of the side recess 33, and both the supports 27 and 28 are in a generally vertical orientation. As the shelf 26 is pulled forward and downward, the panel body 31 slides along the recess 33 to a rear of the recess, and simultaneously, the rear support 28 begins to rotate. As the shelf 26 continues to move forward, a front edge of the shelf 26 moves at an increasing downward rate. As the shelf 26 moves toward the final angled use position, a front edge of the shelf 26 sweeps backward, thus positioning the shelf 26 at an optimal angled use position that is approximately under or slightly rearward of a front edge of the bottom 25 of the furniture unit 21. It is noted that the relative position and angle of the shelf 26 to the furniture unit 21, to the bottom 25, and to the partition 22 can be changed by making dimensional changes to the supports 27 and 28, such as by making the supports 27 and 28 longer and/or different shapes, and/or by redesigning the shapes and locations of slots and holes.

Figure 8:
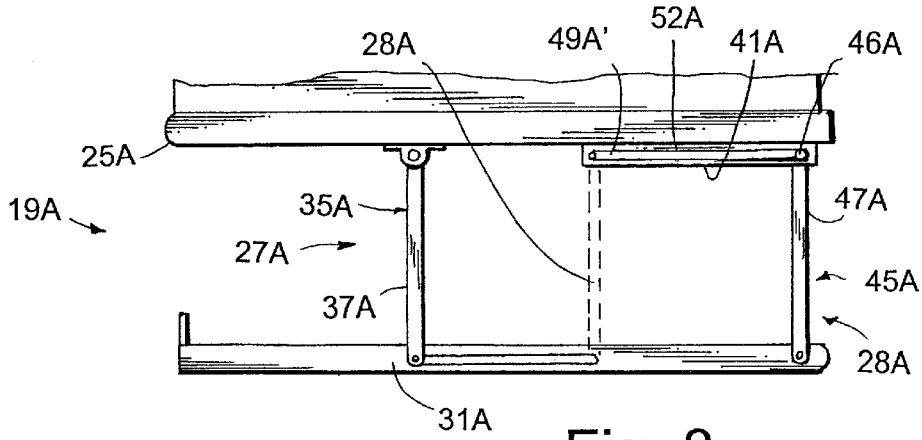
FIGS. 8–10 are side views of a modified shelving apparatus similar to FIG. 1, but including a rear support that both pivots and slides on the illustrated furniture unit.
Figure 9:
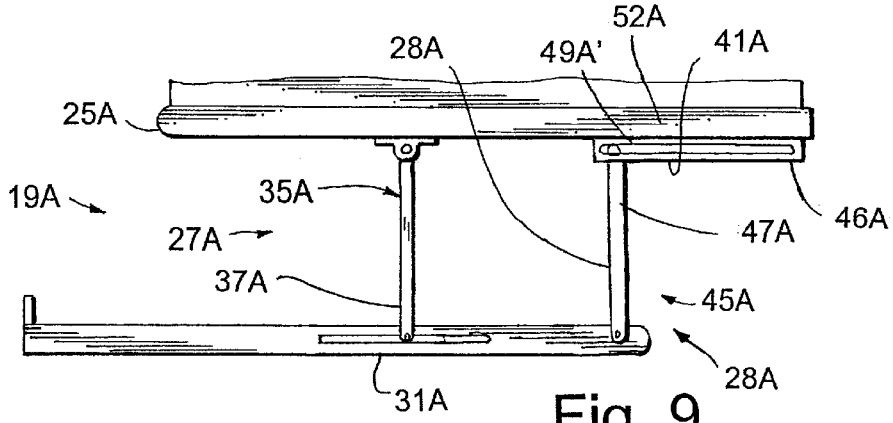

A modified shelving apparatus 19A (FIGS. 8–10) includes several components identical to or similar to the components of shelving apparatus 19. In shelving apparatus 19A, components that are identical to or similar to apparatus 19 are identified with identical numbers along with the letter "A". This is intended to reduce redundant discussion and reduce paperwork, and is not intended for another purpose. In shelving apparatus 19A, the rear support 28A is operably attached to the furniture unit for both pivoting and sliding movement, which results in a construction where the panel body 31A is positioned closer to the bottom 25A than in the shelving apparatus 19.

Figure 10:
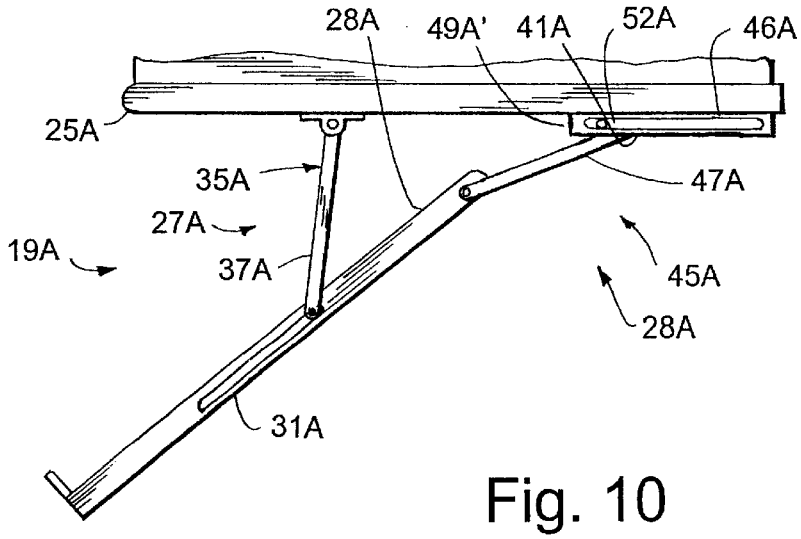

More specifically, in shelving apparatus 19A, the side sections 37A of the rod part 35A of the front support 27A and also the side sections 47A of the rod part 45A of the rear support 28A are made shorter, such that the panel body 31A is positioned vertically closer to the bottom 25A. However, the center trough 41A is forwardly-elongated to form a recess 52A. This allows the center section 46A of rod part 45A to slide forward a desired distance before the rod part 45A is forced to pivot (see FIG. 10). In turn, the panel body 31A slides linearly forward a short distance (see FIGS. 8 and 9) before the supports 27A and 28A cause the shelf 26A to begin rotation and translation to the final use position (FIG. 10). To store the shelf 26A, the above process is reversed. It is noted that a spring can be added to bias center section 46A of the support 28A to a rearward position in the recess 52A to facilitate a smooth and comfortable movement of the shelf 26A as it is adjusted between its use and storage positions. Also, a second stop 49A' can be added to prevent over rotation of the rear support 28A when in the stored position.

Figure 5:
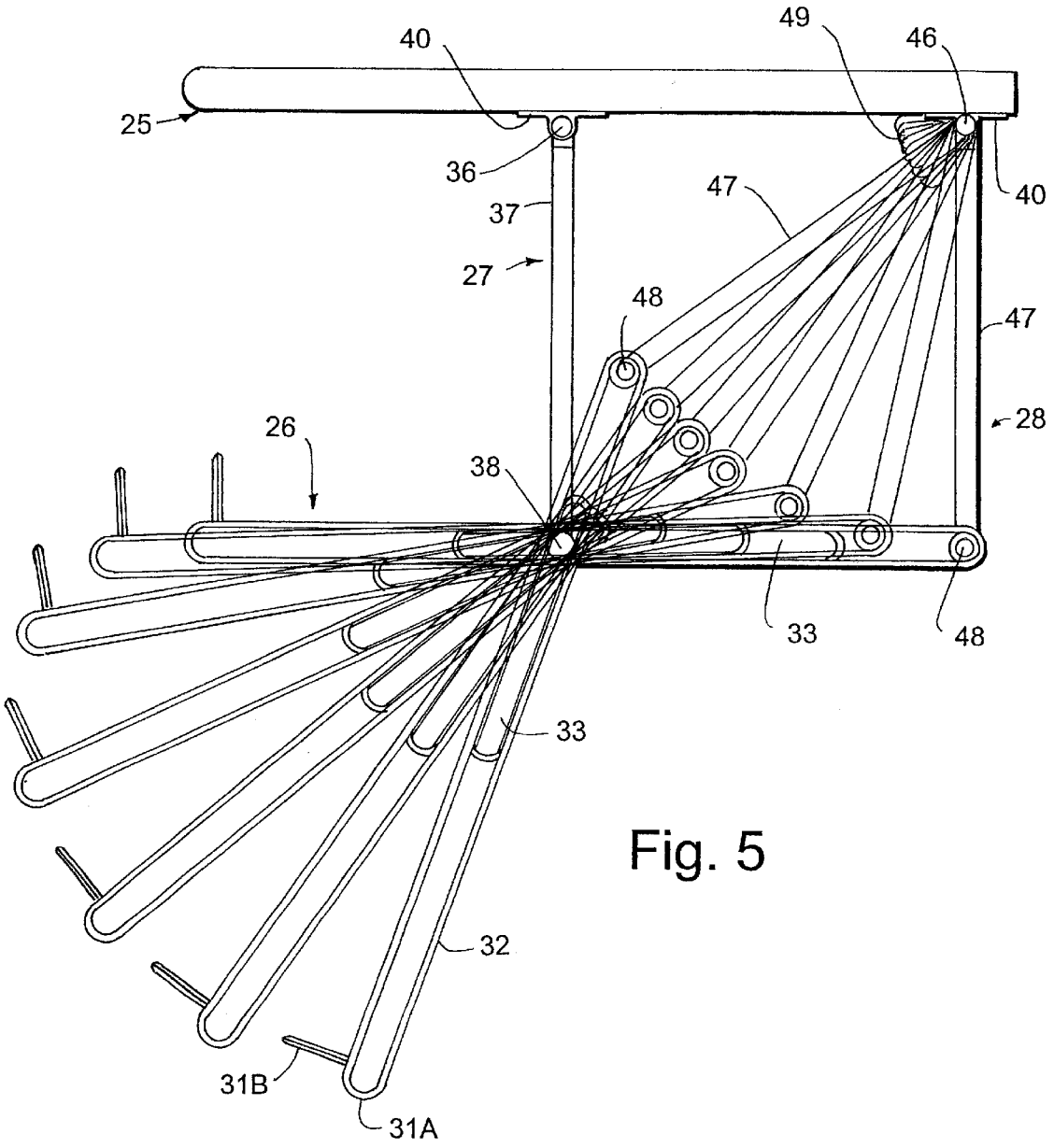
FIG. 5 is a schematic side view of the shelving apparatus shown in FIG. 1, showing movement of the shelf between the use and storage positions.
Figure 6:
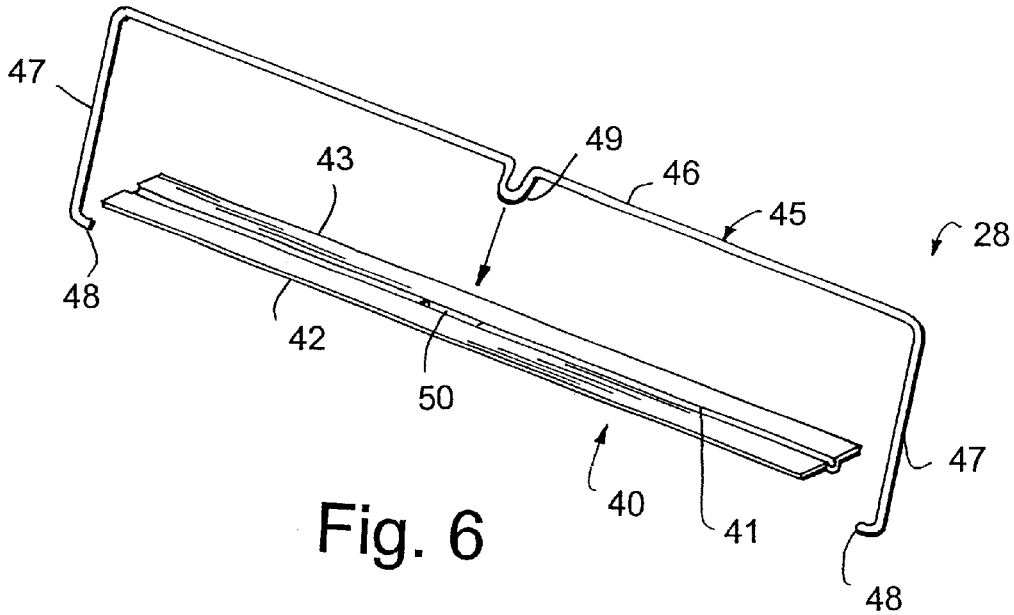
FIG. 6 is an exploded perspective view showing the rear support and attachment bracket of FIG. 1.
Figure 11:
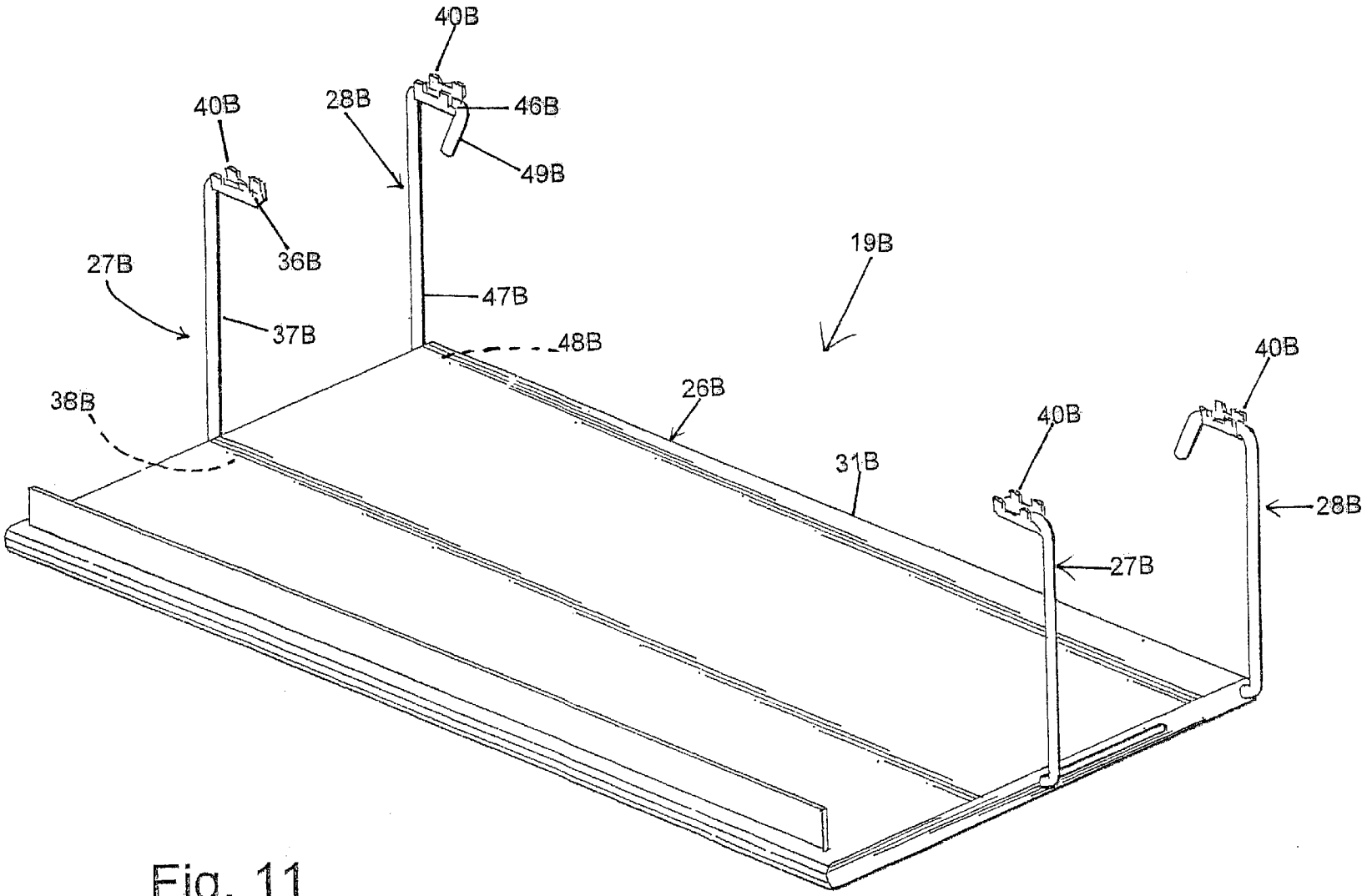
FIG. 11 is a side view of a second modified shelving apparatus similar to FIG. 1.

A second modified shelving apparatus 19B (FIG. 11) includes several components identical to or similar to the shelving apparatus 19. The identical and similar components are identified with identical numbers but with the addition of the letter B. In apparatus 19B, right and left pairs of support members 27B and 28B are used, and the long center sections (36 and 46 of supports 27 and 28) are eliminated. Instead, the front supports 27B include a short section 36B, side section 37B, bent pivot section 38B and a short bracket 40B welded to section 36B, and the supports 28B include a short section 46B, side section 47B, bent pivot section 48B, and a rotatably-supporting short bracket 40B. an angled rod section 49B forms a stop on the support members 28B, and acts similar to the angled looped section 49 on rear support 28 by engaging the bracket 46B and panel body 31B' when shelf 26B is moved to its angled position. In side view, the apparatus 19B looks like and functions like what is shown in FIG. 5.

In the foregoing description, those skilled in the art will readily appreciate that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A document display shelf assembly for use under a furniture unit mounted at a vertical height above a floor, said document display shelf assembly comprising:

a movable shelf panel having a range of motion;

a first support member adapted to be fixedly attached to the furniture unit at a first location;

a second support member with first and second sections adapted for pivotal attachment to the furniture unit and said shelf panel, respectively;

the shelf panel being slidingly attached to said first support member and also pivotally attached to said second support member at the second section; and wherein said shelf panel is slidingly supported by said first support member at a predetermined vertical distance below the first location throughout said range of motion and wherein said shelf panel is pivotally supported by the second support member for vertical displacement, whereby said shelf panel can be moved from a substantially horizontal storage position to a display position where said shelf panel is positioned at a vertical inclination.

2. The document display shelf assembly of claim 1 further comprising:

at least one stop member disposed on said second support member and pivotally movable therewith, so that pivotal movement of said second support member moves said stop member to an abutting position where the stop member is oriented to abut the furniture unit when said shelf panel is in said display position.

3. The document display shelf assembly of claim 1, wherein said shelf panel includes at least one slot disposed in an edge of said shelf panel slidingly engaging said first support member.

4. The document display shelf assembly of claim 3 further comprising a polymeric insert defining a bearing surface located at least partially in said slot.

5. The document display shelf assembly of claim 1 further comprising a projecting lip at a front edge of said shelf panel.

6. The document display shelf assembly of claim 1, wherein said predetermined vertical distance at which said shelf panel is slidingly supported below the furniture unit is substantially equivalent to a vertical length of the first support member.

7. The document display shelf assembly of claim 1, wherein said shelf panel has a front edge and a rear edge, said second support member being attached to said shelf panel adjacent said rear edge and said first support member being attached to said shelf panel between said second support member and said front edge.

8. The document display shelf assembly of claim 1 including a furniture unit having a bottom, and wherein said second support member both slidingly and pivotally engages the bottom of the furniture unit at the first section.

9. A document display shelf assembly for use under a furniture unit mounted at a vertical distance above a floor, said document display assembly comprising:

a shelf, said shelf being movable between a substantially horizontal storage position and a predetermined vertically inclined display position;

a first support member adapted to be fixedly attached to the furniture unit, the shelf being slidingly attached to said first support member;

a second support member having a first section for pivotal attachment to the furniture unit and a second section pivotally engaging said shelf; and at least one stop member disposed on said second support member and pivotally movable therewith, so that movement of said shelf to said display position causes pivotal movement of said second support member to an abutting position relative to the furniture unit, whereby said stop member engages a surface of the furniture unit when the shelf is in the display position.

10. The document display shelf assembly of claim 9, wherein said shelf is supported by said first support member at a defined location and remains spaced from the furniture unit at a predetermined vertical distance throughout said angular range of motion at the defined location.

11. The document display shelf assembly of claim 9, wherein said shelf includes at least one slot disposed in an edge of said shelf, said slot slidingly engaging said first support member.

12. The document display shelf assembly of claim 11 further comprising at least one polymeric insert defining a bearing surface located at least partially in said slot.

13. The document display shelf assembly of claim 9 further comprising a projecting lip at a front edge of said shelf.

14. The document display shelf assembly of claim 9, wherein said shelf has a front edge and a rear edge, said second support member being attached to said shelf adjacent said rear edge and said first support member being attached to said shelf between said second support member and said front edge.

15. The document display shelf assembly of claim 9, wherein said first support member comprises a first pair of support arms engaging opposite side edges of said shelf and said second support member comprises a second set of support arms engaging opposite side edges of said shelf.

16. The document display shelf assembly of claim 9 including a furniture unit with a bottom, and wherein said second support member slidingly and pivotally engages the bottom of the furniture unit.

17. An office furniture system comprising:

a partition panel assembly;

a worksurface panel mounted to said partition panel assembly in a substantially horizontal orientation;

a furniture unit mounted to said partition panel assembly at a vertical distance above the worksurface panel; and a display shelf assembly mounted to said furniture system at a height between said worksurface panel and said furniture unit, said display shelf assembly comprising:

a movable shelf;

a first support member fixedly positioned relative to said furniture unit and slidingly attached to said shelf; and a second support member pivotally mounted relative to said furniture unit and pivotally attached to said shelf, said first and second support members configured to support said shelf through a range of motion between a substantially horizontal storage position and a vertically inclined display position, said shelf being slidingly engaged by said first support member at a point positioned at a predetermined vertical height throughout said range of motion.

18. The office system of claim 17, wherein said furniture unit is a storage cabinet.

19. The office system of claim 17, wherein said display shelf assembly further comprises a stop member disposed on said second support member and pivotally movable therewith so that pivotal movement of said second support member engages said stop member with said furniture unit when said shelf is in said display position.

20. The office system of claim 17, wherein said first support member is fixedly attached to said furniture unit and said second support member is pivotally attached to said furniture unit.

21. The office system of claim 20, wherein said shelf includes at least one slot slidingly engaging said first support member.

22. The office system of claim 21, further comprising a polymeric insert defining a bearing surface within said slot.

23. The office system of claim 17, wherein said shelf further comprises a projecting lip that extends perpendicularly from the shelf at a front edge of said shelf.

24. The office system of claim 17, wherein said shelf has a front edge and a rear edge, said second support member being attached to said shelf adjacent said rear edge and said first support member being attached to said shelf between said second support and said front edge.

25. The office system of claim 17, wherein said furniture unit is a storage cabinet and said shelf assembly is attached to a bottom surface of said storage cabinet, said shelf being positioned substantially parallel to and spaced below said bottom surface when said shelf is in said storage position.

26. The office system of claim 17, wherein said second support member slidingly and pivotally engages the furniture unit and pivotally engages said shelf at a predetermined pivot location on said shelf.

* * * * *